US010786088B2

(12) United States Patent
Herskovic

(10) Patent No.: US 10,786,088 B2
(45) Date of Patent: Sep. 29, 2020

(54) SYSTEM FOR PREVENTING SHEET SLIPPAGE, METHOD FOR PREVENTING SHEET SLIPPAGE

(71) Applicant: Arnold M. Herskovic, Chicago, IL (US)

(72) Inventor: Arnold M. Herskovic, Chicago, IL (US)

( * ) Notice: Subject to any disclaimer, the term of this patent is extended or adjusted under 35 U.S.C. 154(b) by 71 days.

(21) Appl. No.: 16/043,971

(22) Filed: Jul. 24, 2018

(65) Prior Publication Data

US 2020/0029701 A1 Jan. 30, 2020

(51) Int. Cl.
*A47C 21/02* (2006.01)
*A47C 21/00* (2006.01)

(52) U.S. Cl.
CPC ..... *A47C 21/022* (2013.01); *Y10T 24/23* (2015.01)

(58) Field of Classification Search
CPC ..... A47C 9/02; A47C 9/0207; A47C 9/0223; A47C 9/0238; A47C 9/0246; A47C 9/04; A47C 21/022; A47G 9/02; A47G 9/0207; A47G 9/0223; A47G 9/0238; A47G 9/0246; A47G 9/04; Y10T 24/23
USPC ..... 5/496, 498, 482; 24/72.5
See application file for complete search history.

(56) References Cited

U.S. PATENT DOCUMENTS 672,881 A * 4/1901 Allen ..... A47C 21/022 24/72.5
829,118 A * 8/1906 Meek ..... A47C 21/022 24/504
1,584,387 A * 5/1926 Littlejohn ..... A47C 21/022 5/498
2,022,169 A * 11/1935 Yamashiro ..... A47C 21/022 24/564
2,321,394 A 6/1943 King
2,772,460 A * 12/1956 Berkowicz et al. ... A47D 15/02 24/72.5
3,094,807 A * 6/1963 Dorman ..... A63H 27/10 446/222
3,823,443 A * 7/1974 Takabayashi ..... A44B 11/12 24/186
3,978,555 A * 9/1976 Weisenthal ..... A44B 11/14 24/543

(Continued)

OTHER PUBLICATIONS

Sheet Huggers Product Page retrieved from bedbathandbeyond.com on Jun. 29, 2015.

*Primary Examiner* — Robert G Santos
(74) *Attorney, Agent, or Firm* — Cherskov Flaynik & Gurda, LLC

(57) ABSTRACT

The invention provides a system for preventing sheet slippage having a sheet retention device configured to at least partially underlie a mattress having a first flat member having a first surface; at least one second flat member attached to the first flat member having a second surface, where the first and second flat members have a closed configuration where the first and second surfaces oppose each other, an open configuration where the first and second surfaces are perpendicular to each other, and an infinite number of positions in between the open and closed configurations; and at least one retaining member in communication with the first surface. The invention also provides a method for using the invented system for preventing sheet slippage.

11 Claims, 13 Drawing Sheets

(56) References Cited

U.S. PATENT DOCUMENTS

| | | | | | |
|---|---|---|---|---|---|
| 4,541,137 | A * | 9/1985 | Murray | A47C 21/022 | 24/72.5 |
| 4,794,660 | A | 1/1989 | Hawkrigg | | |
| 4,829,617 | A * | 5/1989 | Dameron | A47C 21/022 | 24/306 |
| 4,897,900 | A * | 2/1990 | Baggett | A41B 15/02 | 24/3.5 |
| 5,301,392 | A * | 4/1994 | Richman | A63H 27/10 | 24/30.5 R |
| 5,333,361 | A * | 8/1994 | Schaede | A41F 9/007 | 24/182 |
| 5,377,391 | A * | 1/1995 | Foster | A47C 21/022 | 24/301 |
| 5,400,478 | A * | 3/1995 | Levinsohn | A47C 21/022 | 24/72.5 |
| 6,161,235 | A * | 12/2000 | Smith | A47C 21/022 | 5/496 |
| 6,189,186 | B1 | 2/2001 | Boden | | |
| 8,028,381 | B2 * | 10/2011 | Murray | A47H 23/01 | 160/395 |
| D701,064 | S * | 3/2014 | Baker | D6/607 | |
| D712,179 | S * | 9/2014 | Baker | D6/607 | |
| 8,918,931 | B1 * | 12/2014 | Baker | A47C 21/022 | 5/482 |
| 9,163,697 | B2 * | 10/2015 | Whaley | A47C 21/022 | |
| 9,328,799 | B2 * | 5/2016 | Whaley | A47C 21/022 | |
| 2009/0205166 | A1 * | 8/2009 | Murray | A47H 23/01 | 16/221 |
| 2014/0283301 | A1 | 9/2014 | Whaley | | |
| 2015/0096123 | A1 * | 4/2015 | Whaley | A47C 21/022 | 5/496 |
| 2020/0029701 | A1 * | 1/2020 | Herskovic | A47C 21/022 | |

* cited by examiner

SYSTEM FOR PREVENTING SHEET SLIPPAGE, METHOD FOR PREVENTING SHEET SLIPPAGE

BACKGROUND OF THE INVENTION

1. Field of the Invention

This invention relates to an apparatus for preventing sheet slippage, more specifically, the invention relates to a device and method for retaining bed sheets on a mattress.

2. Background of the Invention

Beds, whether found in a hospital, hotel, home, or elsewhere, almost always feature a mattress cover. Commonly, mattresses are overlaid with a sheet or other covering either for the comfort of the user or for sanitary purposes. Many of the various mattress coverings (such as sheets) suffer from the same disadvantage: slippage so as to dislodge from the mattress corners.

Thus, a need in the art exists for preventing sheet slippage from a bed or mattress. Ideally, the apparatus would be small, easy to manufacture and use, and passive, requiring no maintenance between replacements of bedclothes. The apparatus would also be adaptable for use with standard sheets.

SUMMARY OF INVENTION

An object of the invention is to provide an apparatus for preventing dislodging of bedclothes that overcomes many disadvantages of the prior art.

Another object of the present invention is to provide an apparatus for continuously preventing sheet slippage on a mattress. A feature of the invention is that the system is reversibly attached to the sheet and only needs to be detached and reattached when removing and replacing bed clothing. An advantage of the apparatus is that it retains bed clothing at constant tension without need for adjustment.

Yet another object of the present invention is to prevent sheet slippage on a mattress without any input of energy. A feature of the invention is that the system utilizes the force of gravity on a mattress to secure a bedsheet to the invented system. An advantage of the invention is that hardware such as clamps or other movable parts are not necessary to retain the bedsheet.

Yet another object of the present invention is to provide a device to prevent sheet slippage that is easily installed onto a mattress. A feature of the invention is that it is installed after fitting of a sheet onto the mattress. An advantage of the invention is that the device and sheet may be installed separately. A further advantage of the invention is that the entirety of installation comprises attaching a sheet to the invention which subsequently retains the sheet by gravity and without the need for complex threading of the sheet through the invention or folding the sheet once retained in fully deployed configuration by the invention. The device is adapted to receive any size and thickness sheet with varying textures.

Briefly, the invention provides a bed sheet retention device configured to at least partially underlie mattress, the device comprising: a first flat member having a first surface; at least one second flat member having a second surface, and wherein the first member communicates with the second flat members in a closed configuration wherein the first and second surfaces oppose each other, in an open configuration wherein the first and second surfaces are perpendicular to each other, and an infinite number of positions in between the open and closed configurations; and at least one sheet retaining member in communication with the first surface.

Also provided is a method for preventing slippage of bedsheets comprising: installing at least one sheet retention device such that the sheet retention device reversibly receives a portion of bed sheet, wherein the portion of bed sheet overlays a mattress.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

Figure 1:
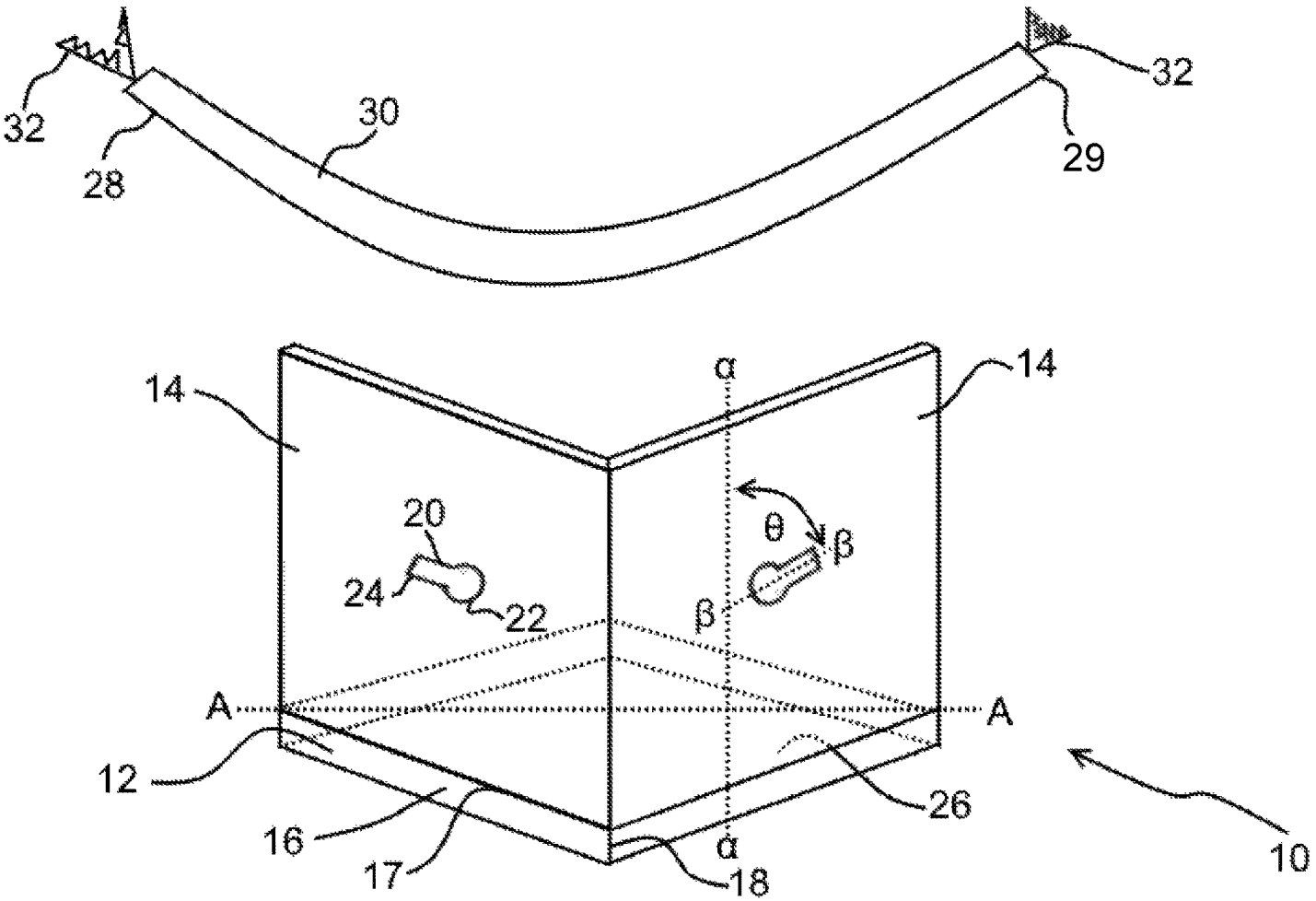
FIG. 1 depicts a sheet retaining system, in accordance with the features of the present invention.

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Generally, the invention comprises a device and method to prevent bedclothes that are installed on a mattress from becoming loose or otherwise dislodged. The device is adapted to receive any mattress covering. The device and method can also be used to impart a myriad of tension to the bedclothes. As used herein, "bedclothes" is synonymous with "mattress covering" and means any type of covering that is applied to a mattress including, but not limited to, fabric sheets, plastic sanitary sheets, fitted sheets, non-fitted sheets, mattress pads, etc.

An embodiment of the invention uses two flat members that are in rotatable communication with each other to create a joint. The joint creates an axis around which planar surfaces defined by the flat members can opposed each other in a first configuration, or open away from, and not opposed to each other in a second configuration. Two components that are "hingedly engaged," "in hinged communication," or "hingedly joined" have such a joint around which the two components can open away from each other, such a joint possibly but not necessarily comprising a hinge. As such, the two surfaces are in rotatable communication with each other so as to be positioned in an infinite number of configurations relative to each other. This allows for bedclothes to be secured on surfaces which may be flat, or curved, or irregularly formed.

The present invention is a system for retaining bedsheets on a mattress so as to enable a sheet to substantially cover at least a first surface of the mattress by anchoring the invention to a laterally facing side and/or a second surface of the mattress. In an embodiment, the system utilizes a tensioning member to resist slippage of a bed sheet from a bed or mattress. In an alternative embodiment, the invented system leverages the force of gravity to reversibly retain a bed sheet in its installed position. The surfaces may be planar, curved, or define irregular topography.

An embodiment of the invention is useful in settings using a bed. As such, the instant invention can be used at home, hospitals, hotels, anywhere a bed or mattress is used and covered in bedclothes. The present invention can be used with any bed or mattress covering whether that covering is fitted or non-fitted.

Device Detail

FIG. 1 shows a perspective view of an embodiment of the present invention. The device generally labeled as 10 comprises a base plate 12 and two walls 14 generally orthogonally attached at one of their edges to the base plate. The base plate 12 is generally flat and rectangular in shape. FIG. 1 shows the base plate 12 as having straight sides 16 and sharply defined corners 18. Preferably the corners are configured at 90 degrees but suitable configurations fall into the range of 60 and 120 degrees.

The sides 16 and or the corners 18 of the base plate may be rounded. The base plate 12 and walls 14 can be made from any resilient material including metal, plastic, wood, and combinations thereof. The plate and walls may be rigid or semi rigid in nature. Further, the plate and walls may be radio opaque or translucent.

The construct created from the base 12 and the walls 14 may be manufactured (i.e. molded, etched, or carved) as a single piece such that the base and walls are integrally molded. Alternatively, the walls are permanently or reversibly attached using methods appropriate for the materials used, exemplary methods including, gluing, welding, hook-and-pile, nailing or screwing the walls and base together. The base plate 12 is shown in FIG. 1 as being rectangular. To confer rigidity between the walls, a truss or strut may span from one edge of first wall to an edge of a second wall.

In an alternative embodiment, the base plate 12 is triangular. Such a shape is achieved by modifying the afore described base plate by bisecting it though its diametrically opposed corners, as depicted in line A. In this embodiment, the distal portion of the original base plate is eliminated to define a triangular baseplate. Alternatively, the distal portion is folded underneath the hypotenuse line of the triangular portion of the base plate. Subsequently, this folded portion may be redeployed to provide means for additional frictional engagement of the device to the second planar surface of the mattress.

The device can be fabricated to fit a bed or mattress of any size. For example, the base plate 12 may have a length between approximately 2 inches and approximately 12 inches, a width between approximately 2 inches and approximately 12 inches, and a depth of approximately 0.25 inches to approximately 1 inch. The walls 14 can be fabricated to rise any distance from the base plate 12 and typically rise between approximately 3 inches and approximately 25 inches from the base plate 12.

In the embodiment of the device 10 shown in FIG. 1, the walls meet at a corner 18 of the base plate 12 and define a void between the walls and the baseplate that approximates the shape of a corner of a mattress, such that the void is adapted to reversibly receive the corner of the mattress. The walls 14 extend from the terminating edge 17 of the base plate and meet at the corner 18 of the base plate 12 such that the angle between the walls is typically between approximately 90° and approximately 120°. Construction material may be chosen such the angle can be molded to fit snugly with the corner of the mattress after the device is installed on the mattress.

At the approximate center of each wall 14, there is a keyhole shaped, transversely extending aperture 20 through the wall 14 with the enlarged or circular portion 22 of the keyhole 22 facing the corner 18 and the relatively more narrow or rectangular portion 24 facing away from the corner 18. The keyholes have a first surface contiguous with the outwardly facing surface of the walls 14 and a second surface contiguous with an inwardly, mattress-contacting surface of the walls. In an embodiment, the keyhole apertures 20 are disposed on the walls 14 such that the longitudinal axes $\beta$ of the keyholes are approximately parallel to the upwardly facing surface 26 of the base plate. In other embodiments, the keyholes 20 are disposed on the walls 14 such that the longitudinal axes of the keyholes $\beta$ are at an angle $\theta$ to the vertical axes $\alpha$ of the walls. Generally $\theta$ will be between 0° and 90°, and preferably between 10 and 45°.

One of the first surfaces of the keyholes 20 receive a first end 28 of a resilient member 30, the second surface of the other keyhole 20 then receiving a second end terminating end 29 of the resilient member 30 such that both of the terminating ends 28, 29 then extend outside the area of the base plate 12. In this configuration, a medial portion of the resilient member 30 resides or otherwise is maintained within the void created between the walls 14 and the baseplate 12.

The resilient member 30 comprises an elastomeric polymer. Alternatively, the resilient member 30 can be a spring of a small enough diameter to fit through the enlarged (e.g., circular) portion 22 of the keyhole apertures 20. Securing means 32 are reversibly attached to the terminating ends 28 of the resilient members. Securing means 32 can comprise any means capable of securely but reversibly engaging a bed sheet. Exemplary securing means include various types of clamps that are biased toward a closed configuration but can be reversibly opened such as spring clips. Spring clips are used only as an example. Any fastener that can be reversibly closed and opened may be suitable for use in the instant invention. Other fasteners include magnets, pin and aperture configurations, hook and pile configurations, button-button hole configurations, and combinations thereof.

Figure 2A:
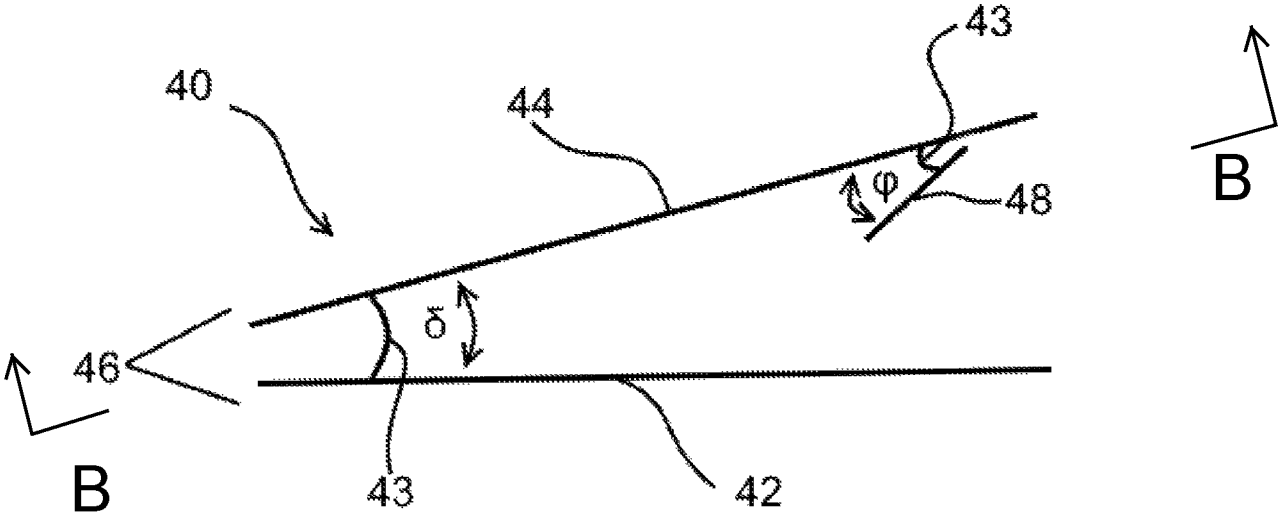
FIG. 2A depicts an alternative sheet retaining system, in accordance with the features of the present invention.

FIG. 2A shows an alternative embodiment of the invented sheet retaining device generally designated as 40. The device 40 is generally comprised of a first flat substrate 42 (e.g., first plate), and a second flat substrate 44 (e.g., second plate) each plate having a first proximal end 46 and a second distal end 47. The plates are in hinged communication with each other at their proximal ends 46 so as to resemble a first clam shell. In operation, the device 40 can be positioned under a mattress so that the exterior surface of either the first 42 or second substrate 44 are in contact with the underside of a mattress. In an embodiment, one of the first 42 or second 44 substrates are reversibly attached to the underside of a mattress using any suitable attachment means such as snaps, buttons, adhesive, hook and pile attachment means, magnets, and combinations thereof.

A region of a medially facing surface near the distal end of the second flat substrate or plate 44 is in hinged communication with a smaller third substrate 48 to form a second clam shell which opens in a direction opposite the opening of the first clam shell. This smaller third substrate has a first proximal end attached to the medially facing region. A free, distal end of the smaller third substrate 48 points toward the proximal ends of the first and second flat substrates 42, 44 and opens in a medially directed arc so as to rotate toward an inwardly facing surface of the first plate 42 at an angle Cφ The angle φ depends on the force applied to the retaining member 48 by a user retained sheet, but is typically between 1° and 45°.

The third substrate 48 has a first surface facing the inwardly facing surface of the first flat substrate or plate 42 and a second surface facing the inwardly facing surface of the second flat substrate or plate 44. This second surface may define a fabric retention surface, embodying friction enhancement surface (e.g., roughened, fluted, ridged, sticky, etc.), a mechanical means for fabric retention, (e.g., buttons, hooks, one part of a hook-and-pile fastener, etc), or a combination of friction enhancement and mechanical attachment. This enhances frictional engagement with whatever contacts those interior surfaces The hinged communication between the first and second substrates and between the second and third flat substrates is facilitated by joining members 43 that allow for two joined elements to rotate about the member 43. For example, the joining member 43 can be a piano-type hinge, a seam of pliable adhesive, semi-rigid plastic substrate, or fastening devices such as staples, screws or rivets comprising material that can flex.

FIG. 2A further depicts an angle δ between the plates 42, 44. Angle δ is large i.e. between approximately 15° to 45° when a force (indicated by the double headed arrow) is applied to separate the two plates 42, 44 into an open position. At rest, the device 10 is biased toward a closed position such that the plate 42 will contact the retaining member 48 and the values of δ will be small i.e. between 1° and 20°.

Figure 2B:
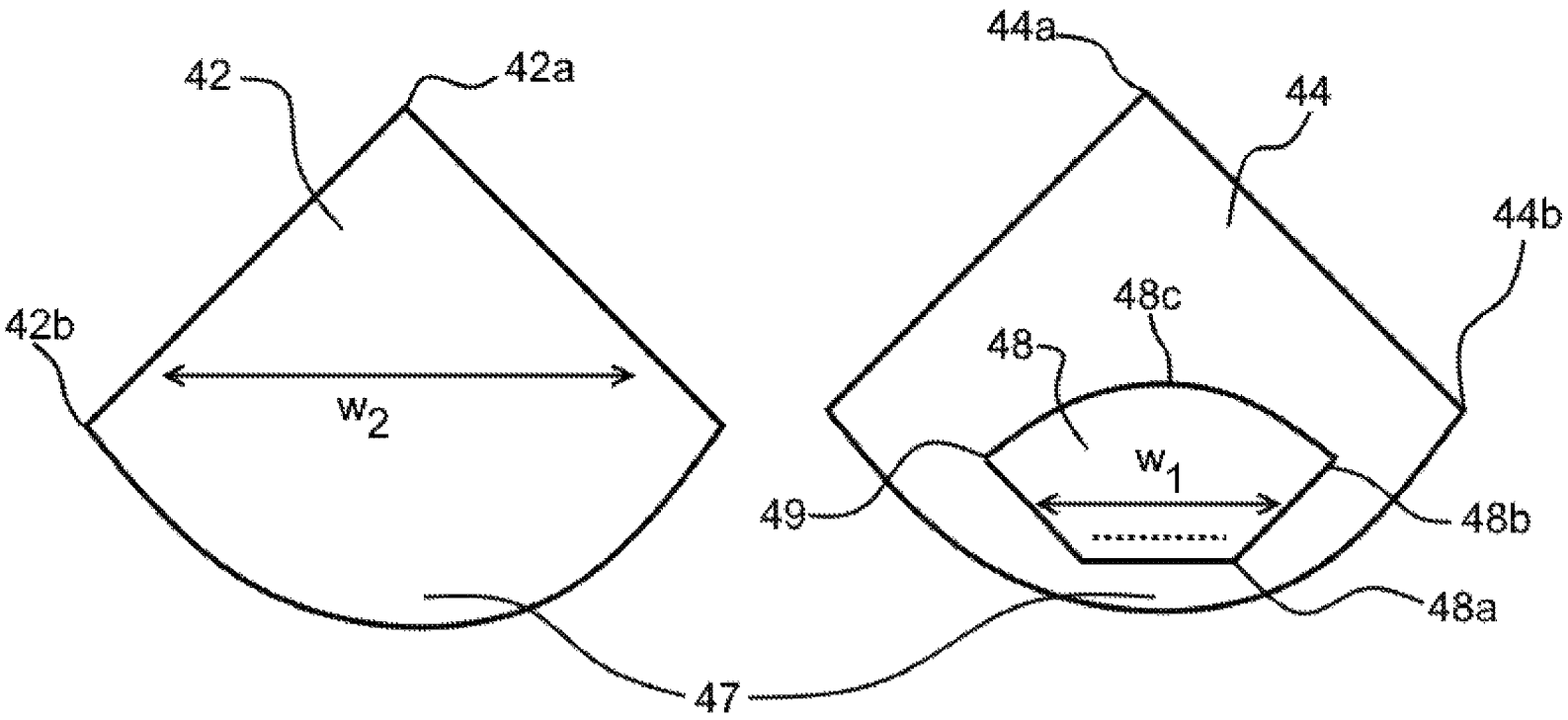
FIG. 2B depicts an exploded view of the sheet retaining system shown in FIG. 2A, in accordance with the features of the present invention.

FIG. 2B shows a plan view of both plates, separated for illustration. The inwardly facing surface of the first flat substrate 42 is smooth. The inwardly facing surface of the second flat substrate or plate 44 is also shown as a view of FIG. 2A taken along line B-B. This second flat substrate 44 supports the third flat substrate 48 and forms a sheet retaining member 48 therewith. The retaining member 48 is substantially flat and features a first end 48*a* (commensurate with the proximal end of the third flat substrate) and a second end 48*b* (commensurate with the distal end of the third flat substrate). The retaining member resembles jaws and opens toward the proximal ends of the first and second substrates such that the retaining member jaw faces opposite the jaw opening defined by the first and second flat substrates.

The width $w_1$ of the member 48 increases between its attached proximal end 48*a* and second (i.e., it's free unattached distal) end 48*b*. The periphery 48*c* of the second end 48*b* of the member terminates in a semicircular shape wherein the diameter of the semicircle is slightly larger proximate to the second end 48*b* to form shoulders 49. When in use, the wedge shape member 48 asserts a force over its entire periphery on a held sheet. The wedge shape spreads the force exerted on the sheet over a larger area, the entire length of the 48*c* of the second end 48*b* of the member 48. In alternative embodiments, the member 48 may be any regular or irregular two dimensional shape.

Similarly to the retaining member 48, both outer plates 42, 44 have a width $w_2$ that increases from the first end of the plates 42*a*, 44*a* to the shoulders 42*b*, 44*b* of the plates. Generally, the width $w_1$ between the shoulders 49 of the retaining member is between approximately 50 to approximately 75 percent the width $w_2$ of the outer plates 42, 44 at their shoulders. This range is illustrative and not meant to be limiting. The ratio of $w_2$ to $w_1$ can be customized to accommodate any type of sheets or combination of sheets.

The plates 42, 44 generally mimic the semi semicircular shape of the terminating end 48*c* of the retaining member. Alternatively, the plate 44 featuring the retaining member 48 will have the same semicircular shape as the terminating end 48*c* of the member 48, while the other plate 42 is rectangular in shape. In still yet another alternative embodiment, both of the plates 42, 44 are rectangular in shape. FIGS. 2A-D show the invented device as having sharp corners. This is just for illustrative purposes. In an embodiment, all the corners featured on the device are smoothed as to prevent tearing or piercing contacted bedclothes.

In general, all the embodiments shown and described herein can be manufactured to accommodate any mattress and sheet type and weight. Preferably, any straight edges or walls in any of the embodiments will have lengths of between approximately two to approximately nine inches. However, these dimensions are illustrative and not meant to be limiting. Any dimension involved in any embodiment of this invention can be customized to accommodate a particular mattress and/or sheet or combinations of sheets.

In an embodiment, any surface of the devices shown and described herein can feature frictionally engaging material to apply friction to a contacted mattress or bedclothing to further enhance the slippage prevention provided by this invention. For example, the mattress facing surfaces of the devices shown and described herein can feature frictionally engaging material to prevent movement of devices with respect to the mattress. Further, any interior surfaces of these devices that can come in contact with a held sheet may similarly receive frictionally engaging material to provide frictional resistance to sheet slippage. The devices can reversibly receive frictionally engaging material through or can receive a complete coating of frictionally engaging material. Any frictionally engaging material can be used. Exemplary frictionally engaging materials include elastomeric polymers such as rubber and equivalents thereof.

Figure 2C:
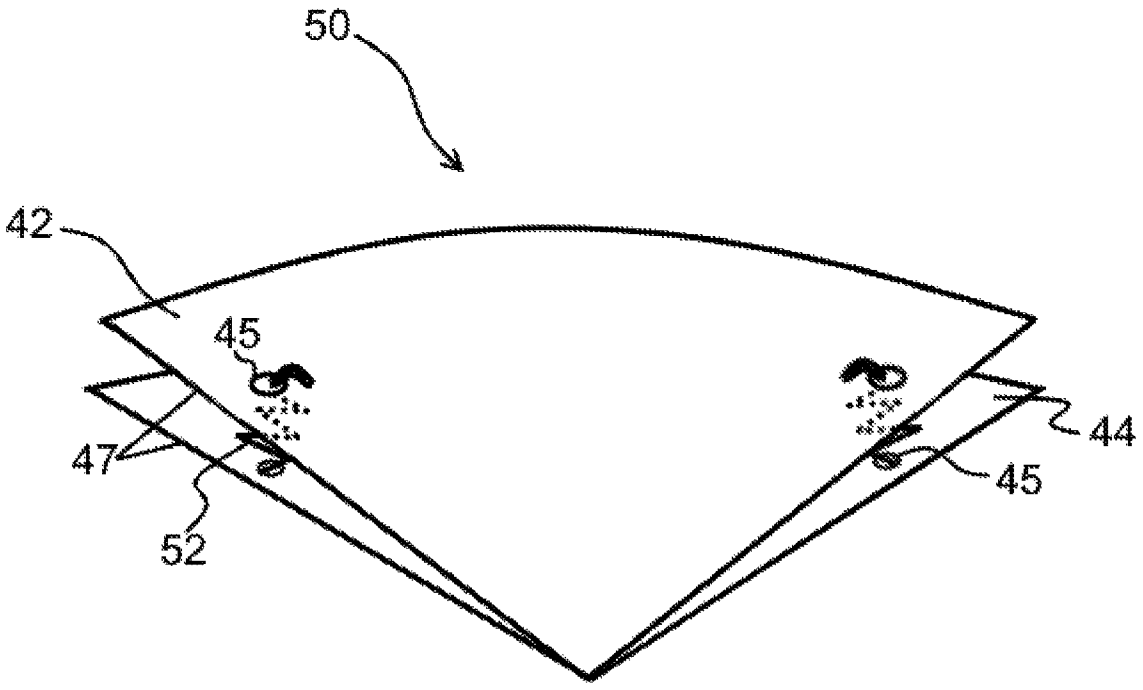
FIG. 2C depicts an alternative embodiment of the sheet retaining system of FIG. 2A, in accordance with the features of the present invention.

FIG. 2C shows an alternative embodiment 50 wherein the plates 42, 44 are connected with biasing members 52 connecting the lateral edges 47 of the plates 42, 44. These biasing members can comprise springs or elastomeric members that urge the plates 42, 44 toward each other or away from each other. In this embodiment, radially extending lateral sides 47 define apertures 45 adapted to receive the terminating ends of a spring 52 or biasing member. Alternatively, the spring 52 or biasing member can either be integrally or removably attached to the plates 42, 44.

Figure 2D:
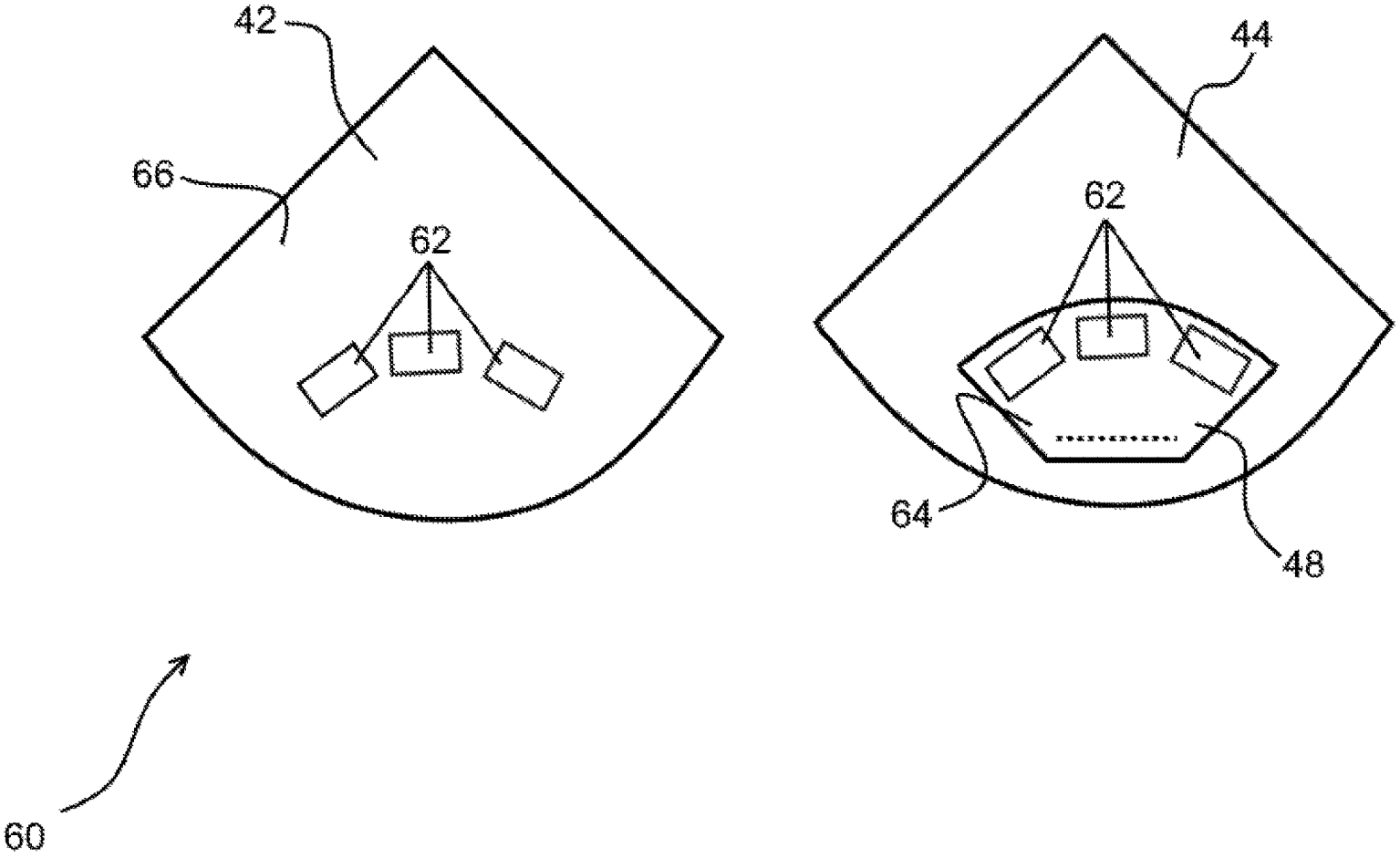
FIG. 2D is an exploded view of an alternative embodiment of the sheet retaining system of FIG. 2A, in accordance with the features of the present invention.

In an alternative embodiment 60, depicted in FIG. 2D, showing the plates separated for better illustrations, magnets 62 are disposed on the medially facing surface 64 of the retaining member 48 and the medially facing surface 66 of the plate 42 not having the retaining member such that the magnets bias the plates toward a closed position. These embodiments, either using a biasing member or magnets, apply retaining forces to a sheet in more ways than just using gravity, as will be discussed infra. The magnets may be reversibly attached to the medially facing surface 64 in a semi-circular configuration as shown, or in a straight line, or in an upside down "V" configuration to coincide with the shapes of the straight surfaces of the surface.

FIGS. 2A-D show the invented device as featuring three substrates, 42, 44, and 48. However, the invention may feature only the two outer substrates, 42 and 44.

Figures 2E, 2F:
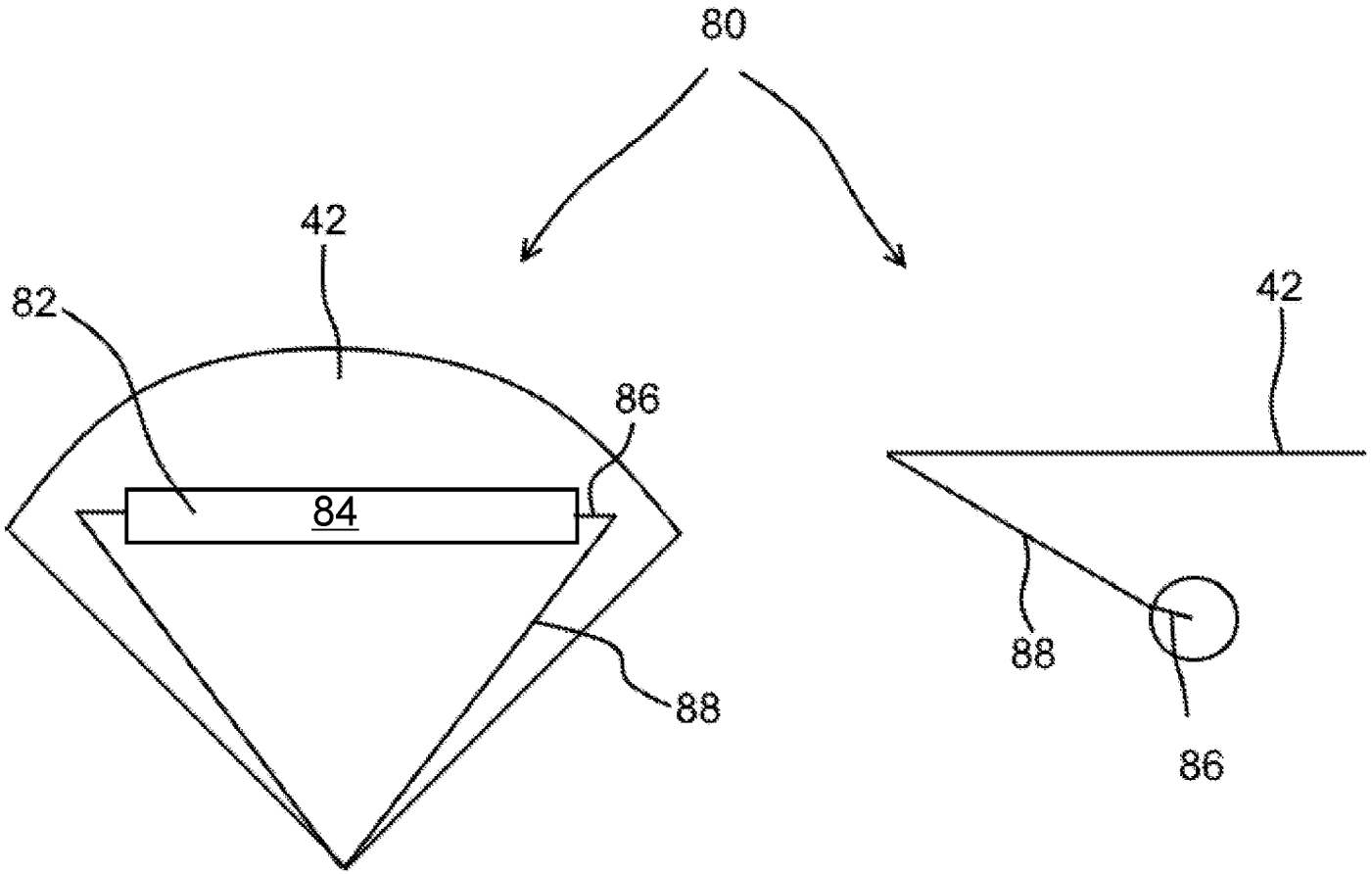
FIGS. 2E and 2F depict an alternative embodiment of a sheet retaining device using a spring biased roller, in accordance with the features of the present invention.

Yet another embodiment 80 is shown in FIGS. 2E and 2F. In this embodiment, one of the substrates is replaced with a spring biased roller 82. The spring biased roller 82 is in hinged communication with one clam shaped substrate 42 such that the roller can be lifted up to insert a sheet between the substrate and roller. The roller is biased toward the substrate and against being lifted from the substrate 42. As such, after a user lifts up the roller to insert a sheet, the roller moves back toward contact with the substrate. This bias places any inserted sheet in frictional communication with the substrate and roller. The roller 82 comprises a cylindrical member 84 that rotates about an axle 86 that is supported by two support arms 88, the support arms 88 in hinged communication with the substrate 42. The topography of the roller may be smooth, or define friction forming surfaces such as ridges, flutes, etc.

Figure 2G:
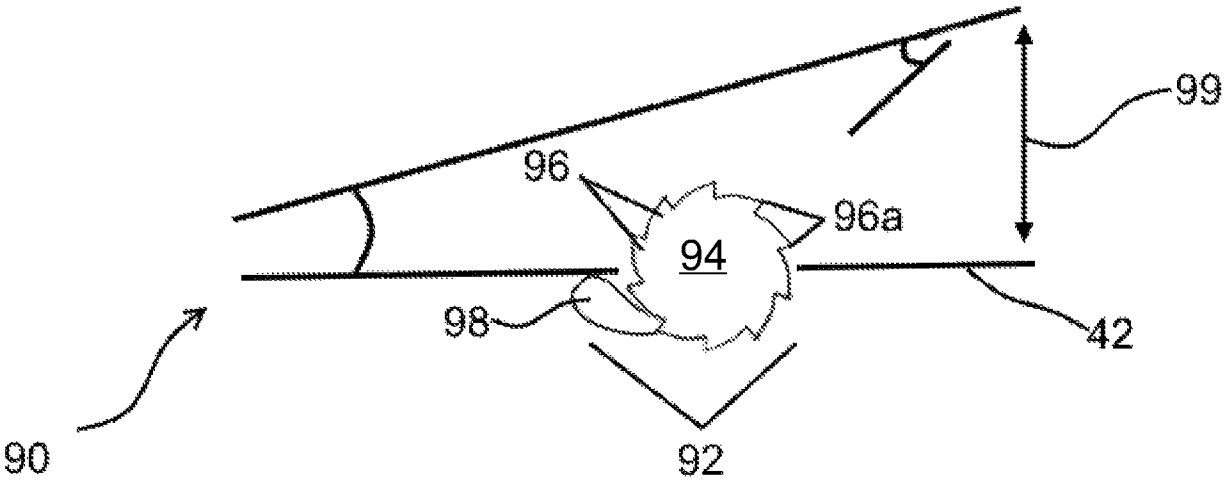
FIG. 2G depicts an alternative sheet retaining device using a ratcheted wheel, in accordance with the features of the present invention.

Another embodiment 90 as shown in FIG. 2G features a ratcheting mechanism 92 disposed in one of the substrates 42. The ratcheting mechanism 92 comprises a ratchet gear 94 having teeth 96 and a prawl 98, the prawl in hinged communication with the substrate 42 and biased towards the ratchet gear. The teeth 96 may be coated with a sticky substance. Alternatively, the teeth 96 may come to a very fine point at their terminal 96*a* portion such that the teeth reversibly pierce a sheet retained by this embodiment of the invented device. The ratchet gear may be spring biased away from the primary opening 99 of the device 90. In this embodiment, a sheet retained by the device is reversibly engaged by the teeth 96 of the ratcheting mechanism 92. Once engaged by the teeth 96, the ratcheting mechanism will allow for or may be biased towards a retained sheet being pulled further into the device. At the same time, the ratcheting mechanism will aid the device 90 in retaining a sheet by resisting the sheet pulling out of the device.

Figure 2H:
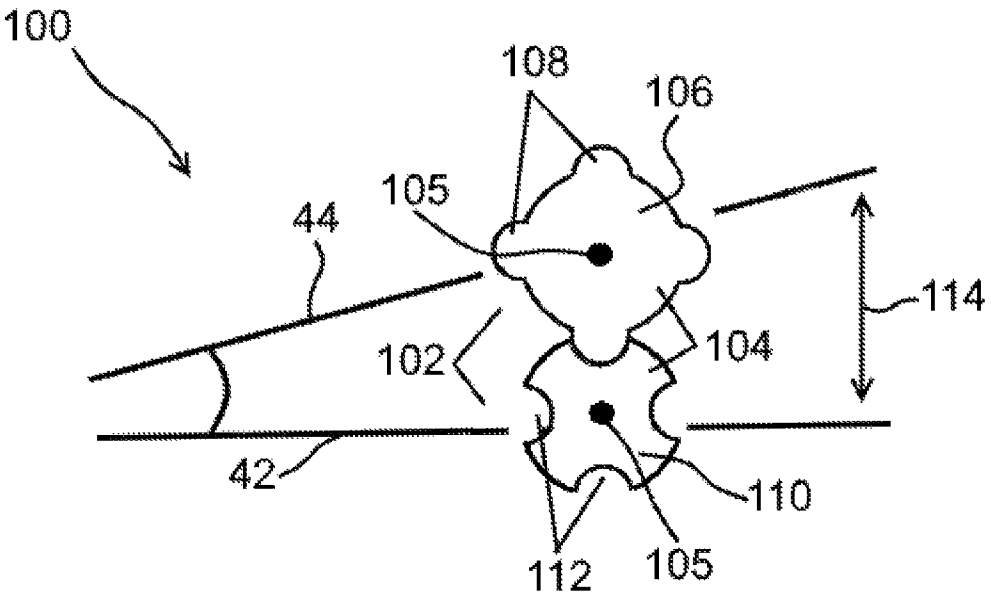
FIG. 2H depicts an alternative sheet retaining device using opposing rollers, in accordance with the features of the present invention.
Figure 2I:
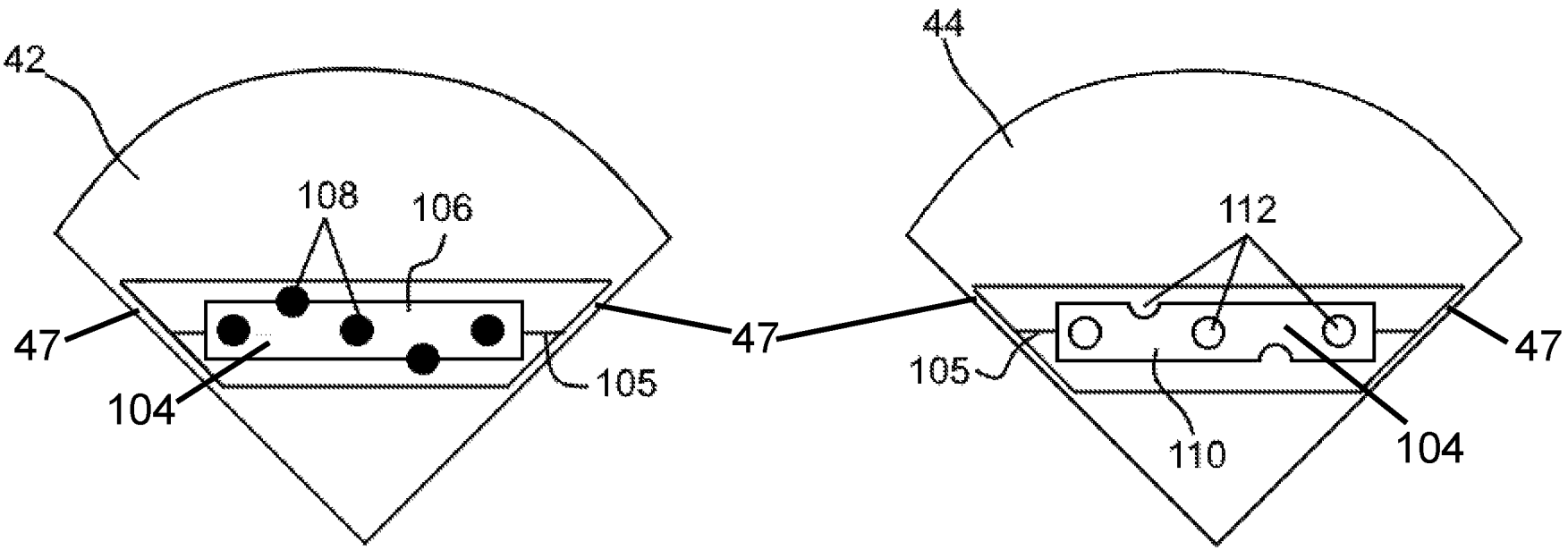
FIG. 2I depicts an exploded view of the sheet retaining system of FIG. 2H, in accordance with the features of the present invention.

Yet another embodiment 100 is shown in FIGS. 2H-2I. This embodiment of the device 100 features an alternative ratcheting mechanism 102 comprising two opposing and interlocking rollers 104, each disposed within one of the plates 42, 44 and extending parallel to the width of the plates ($w_2$ described above and shown in FIG. 2B). These rollers 104 are disposed on axles 105 attaching to edge portions of the plates. A salient feature of this embodiment is the interlocking nature of the two rollers 104. One of the rollers 106 features blunt protrusions or bumps 108 extending from the surface. A plurality of bumps is disposed on the surface of the roller 106. The distribution of bumps on the bumpy roller 106 can be regular or irregular. These bumps 108 are shown as half spheres, but can be any shape. This embodiment 100 features another roller 110 that opposes and interlocks with the bumpy roller 106. The roller 110 that opposes the bumpy roller features countersunk voids 112 in the shape of the bumps 108 on the bumpy roller 106. The voids are positioned on the surface of the roller 110 to reversibly receive an opposing bump. These voids or concave regions to the periphery of the second roller are placed about the circumference of the second roller so that one or more voids may nest or otherwise engage one or more protrusions of the first roller at a myriad of arc angles along each periphery of each roller.

FIG. 2I depicts a plan view of both plates defining the device 100 shown in FIG. 2H. As shown in FIG. 2I, both plates of the device define voids 103 that accommodate the interlocking rollers 104. The axles 105 of the rollers are in rotable communication with the terminal edges 47 of the plates.

In use, a user spreads apart the plates 42, 44 and therefore separates the rollers 104, to insert a portion of a sheet between the rollers 104. One or both of the rollers can be spring biased away from the main opening 114 between the plates. When a sheet is in place between these spring biased rollers, the spring causes the rollers 104 to constantly apply a retaining force (away from main opening of device).

Any of the devices shown and described herein can be made of any material suitably sturdy to withstand the weight of a mattress and supported users thereof. Exemplary materials include wood, plastic, metal, rubber, and combinations thereof.

Sheet Retention Detail

Figure 3A:
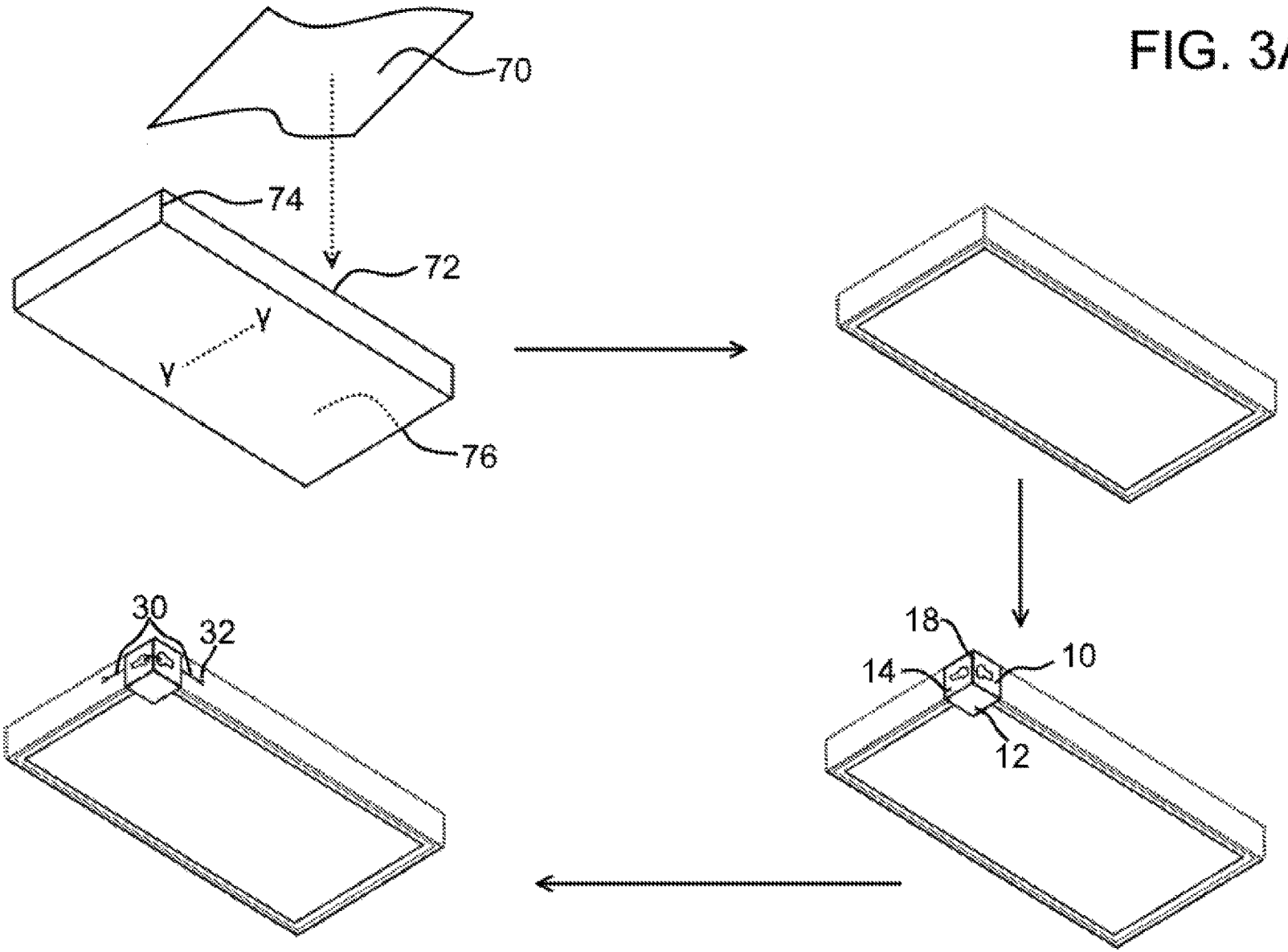
FIG. 3A is a schematic showing a method of using the sheet retaining system of FIG. 1, in accordance with the features of the present invention.

FIG. 3A shows a schematic for using the embodiment of the invention 10 shown in FIG. 1 to secure bedsheets. A user first fits a bedsheet (or other bedclothes) 70 over a bed or mattress 72 to be covered. The user then slides the device 10 under the mattress 72 such that the base plate 12 is under the mattress 72 and a corner of the mattress 74 is surrounded by the walls 14 of the device 10. The user then slides one of the terminating members 28 of the resilient member through the first surface of one keyhole 20 and through the second surface of the other keyhole 20. The user then locks both of the securing means 32 of the resilient member 30 such that the resilient member is reversibly attached to a portion of the sheet 70 on each side of the corner of the mattress 72 overlaid by the device 10. In this configuration, the securing means 32 are preferably fastened to the sheet 70 below the plane defined by the sleeping surface 76 of the sheet covered mattress. FIG. 3A shows the retaining means 32 extending from underneath the device so as to attach to the sheet 70 beyond the walls of the device 10. This provides a means for visually checking engagement of the sheet to the device. In an alternative embodiment, the retaining means 32 are attached to the sheet 70 beneath the walls 14 of the device 10. In yet another embodiment, the ends of the retaining member are inserted first through the second surfaces of the keyholes so that only a medial portion of the retaining member is between the device 10 and the mattress when installed.

Using the device as embodied in FIG. 1, the user only needs to use two devices 10 to fully secure a bed sheet to a mattress. When using two devices, a user secures the device as described above to diagonally disposed corners of the sheet. Alternatively, a user can use two devices to secure a sheet to a mattress wherein each of the devices is disposed under both corners 74 of the mattress 72 on one side of the latitudinal axis y of the mattress 72. In an alternative embodiment of the invention, a device 10 is placed under all four corners of a mattress fitted with a sheet and fastened to the sheet as described above.

Figure 4:
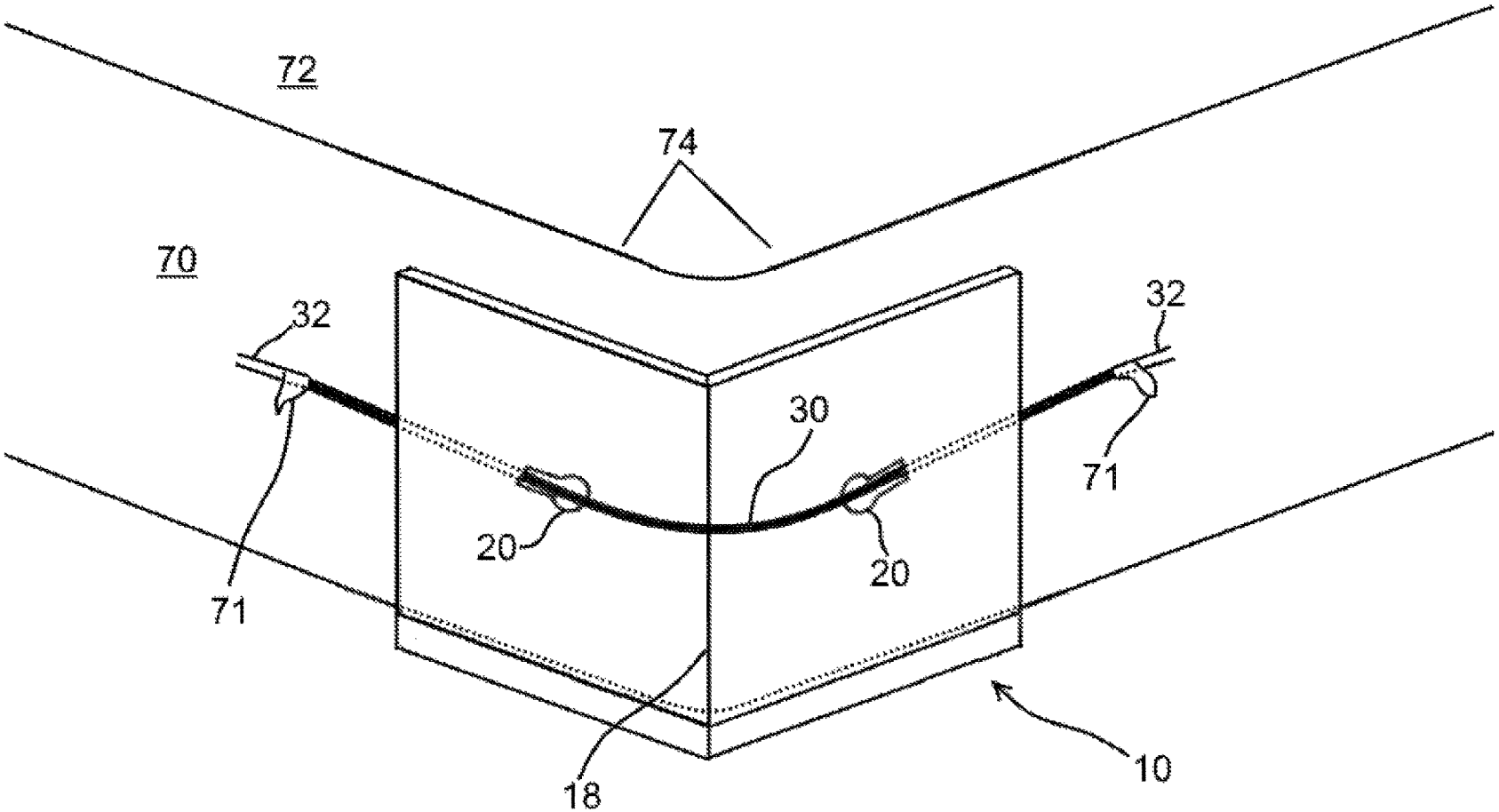
FIG. 4 shows a detail view of the invented sheet retaining system once installed as shown in FIG. 3A, in accordance with the features of the present invention.

FIG. 4 shows a detail view of the device 10 once installed as shown in FIG. 3A. As shown in FIG. 4, once the device 10 is installed, a medial portion of the resilient member 30 extends between the keyholes 20 and over the corner 18 of the device 10. The resilient member then extends from under the device 10 onto both sides of a corner 74 of a supported mattress 72 fitted with a sheet 70. As shown, the securing means 32 on the ends of the resilient member 30 grip and apply a retaining force to a portion of retained sheet 71. This force prevents a sheet from pulling off of an overlaid mattress. Further, the portion of the resilient member that underlays the device 10, provides frictional resistance to the sheet pulling off the mattress.

Figure 3B:
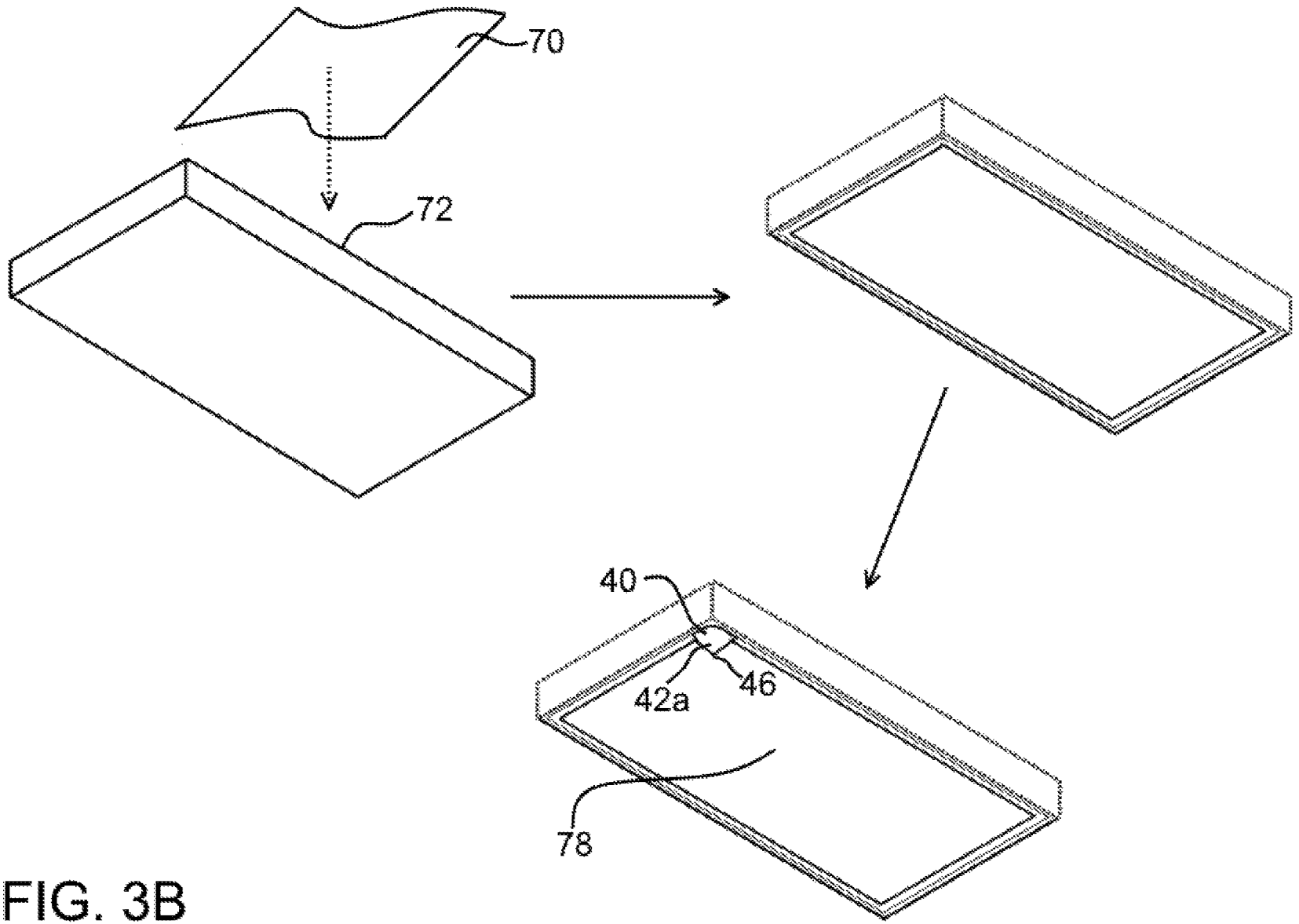
FIG. 3B is a schematic showing a method of using the sheet retaining system of FIG. 2A, in accordance with the features of the present invention.

FIG. 3B shows a schematic for using the embodiment 40 shown in FIGS. 2A-C. Using this embodiment 40, a user first fits a sheet 70 over a mattress 72. The sheet retention device 40 is then installed under any portion of the mattress so as not to be relegated to any one corner thereof. In this way, over or undersized sheets can be accounted for by for example, securing an oversized sheet toward the middle of the underside of the mattress, and an undersized sheet toward the edge of the mattress.

Figure 3C:
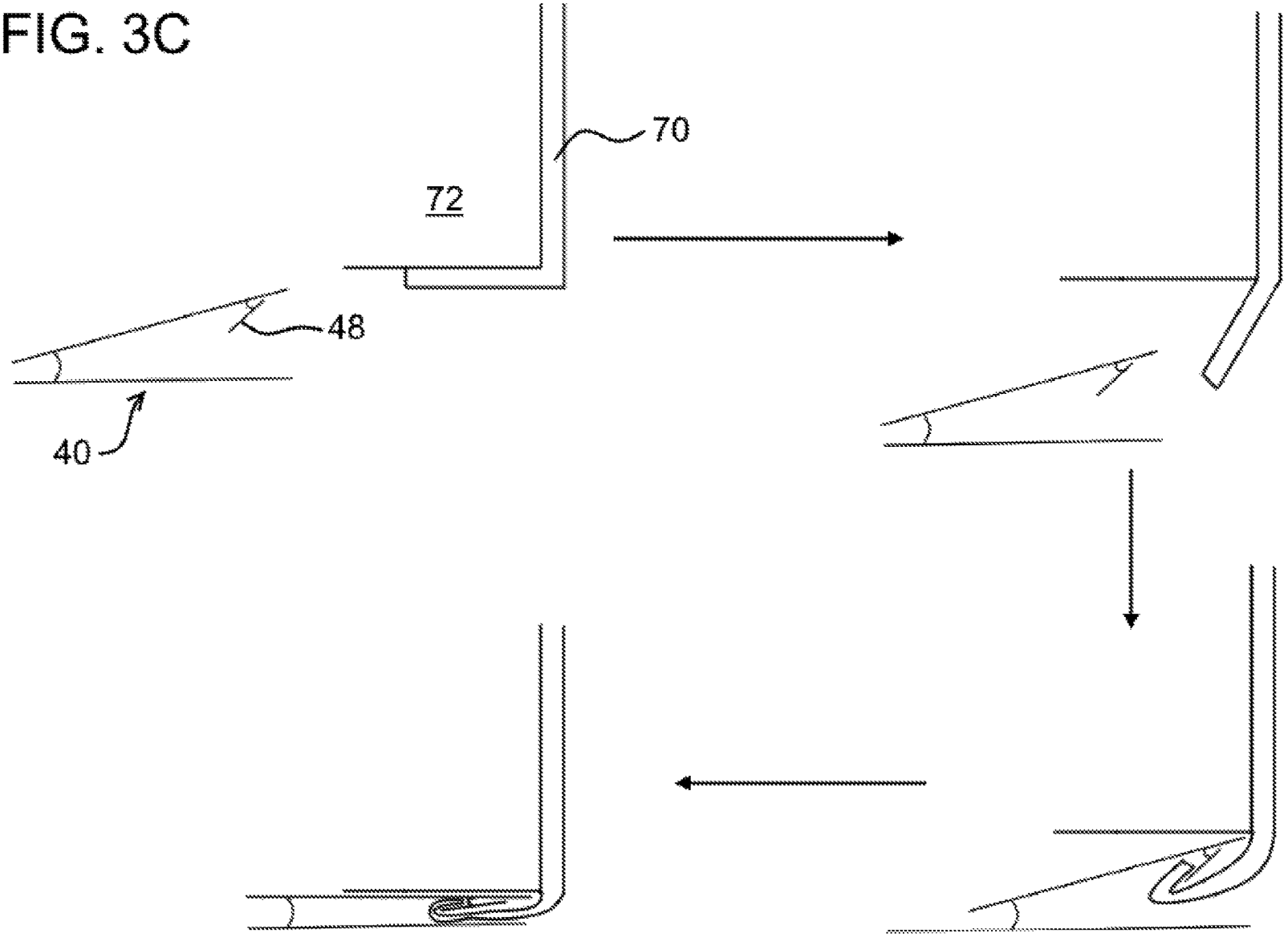
FIG. 3C is a detail view showing the mating of a sheet with an embodiment of the invented sheet retention system while installing said system, in accordance with the features of the present invention.

Installing the device 40 comprises lifting the mattress 70 already fitted with a sheet and positioning the device 40 under the mattress. The device 40 is positioned such that the laterally facing surface of the plate 42 not having the retaining member 48 faces away from the mattress 72 and the corner 46 of the device faces the center 78 of the mattress. A user then slips a portion of the sheet between the plates 42, 44 and under the retaining member. Once the sheet is in between the plates and under the retaining member, the mattress is lowered. When the mattress is lowered, the weight of the mattress on the device applies a force biasing the plates towards each other and preventing sheet slippage. Just as with the embodiment 10 of FIG. 1, only two devices need to be installed as described in this paragraph on two corners as described above. Alternatively, the device 40 can be installed on all four corners that are fitted with a sheet 70. FIG. 3C shows a detail view of how a portion of sheet 70 fits mates with the sheet retention device 40.

FIG. 3B and the preceding paragraph describe the device 40 being installed at the corners of a mattress with a certain orientation. In an alternative embodiment, the devices 40 can be installed to receive any portion of sheet 70 that is underlying the periphery of a mattress. Further, the devices 40 can be installed in any orientation as long as a portion of sheet is received between the retaining member 48 and the plate 44 having the retaining member 48.

In an alternative embodiment, the devices 40 can be reversibly attached to any of the sidewalls of a mattress with appropriate attachment means mentioned above and receive and secure the bedclothes in the same way as in the preceding paragraphs. This embodiment preferably uses a retaining member 48 that is biased toward a small value of the angle φ as shown in FIG. 2A. In addition or alternatively, this embodiment may feature means to bias the two substrates 42, 44 towards each other to form a small δ angle as shown in FIG. 2A.

The embodiment 40 shown in FIGS. 2A-C and 3B does not require that a retained sheet be folded around the device 40 or retained by the device 40 in any other way than a sheet being fit between the retaining member 48 and the plate 44 on which the retaining member is fixed. As such, the plates 42, 44 do not feature any slots for threading a portion of the sheet 70 so that the sheet 70 can be folded around the plates 42, 44 after insertion into the device 40. The embodiment designated as 40 further does not utilize clamps or other gripping mechanisms other than the force of gravity on the device 40 which is retaining a portion of sheet 70.

Any of the devices described herein can be used to hold more than one item of bedclothes at once. For instance, the invented device can be used to simultaneously grip laminated bedclothes, for example both a sanitary and a coplanar regular bedsheet at the same time.

Alternatively, a separate set of devices can be used to grip each article of bedclothes placed on a mattress separately. For instance, two devices can be used to hold a plastic sanitary sheet used to cover a mattress while another two hold the regular bedsheet that is placed over the sanitary sheet. Using this embodiment, the sanitary sheet will not come loose when changing the bedsheet.

A benefit of all the embodiments of the invention is their ease of use and low maintenance nature. When a sheet is fit over a mattress, a user secures the bedsheet using any embodiment of the invented device. When a sheet is replaced, the device is disengaged from the sheet being removed and engaged to the new sheet once it is fit over a mattress. As the invented device maintains sheets in position over a mattress, there is no need to adjust or otherwise maintain the invented device for the duration of use of a sheet.

In an embodiment, the invention comprises A system for preventing sheet slippage comprising: a sheet retention device comprising: a first flat member having a first surface; a second flat member hingedly engaged to the first flat member and having a second surface such that the first and second surfaces oppose each other, the hinged engagement allowing the opposing surfaces to rotate away from each other; and a retaining member in communication with and extending from the first surface of the first flat member and toward the second surface. The retaining member may comprise a flat substrate which extends from a first end which is in communication with the first surface of the first flat member to a second end, wherein the retaining member increases in width between its first and second ends. The system may be configured to receive a portion of a sheet to be retained intermediate the retaining member and the first surface of the first flat member. The portion of sheet to be retained may underlie a mattress. The system of may further comprise a plurality of sheet retention devices. The system may be configured such that each sheet retention device receives a portion of sheet to be retained intermediate its retaining member and first flat member. Each portion of sheet received by a sheet retention device underlies a portion of a mattress. The second end of the retaining member may be contoured.

The invention provides a method for preventing slippage of bedsheets comprising: installing at least one sheet retention device such that the sheet retention device reversibly receives a portion of bed sheet, wherein the portion of bed sheet underlies a mattress. In the method, the sheet retention device may further comprise: a first flat member having a first surface; a second flat member hingedly engaged to the first flat member and having a second surface such that the first and second surfaces oppose each other, the hinged engagement allowing the opposing surfaces to rotate away from each other; and a retaining member in communication with and extending from the first surface of the first flat member and toward the second surface. The retaining member may comprise a flat substrate which extends from a first end which is in communication with the first surface of the first flat member to a second end, and wherein the retaining member increases in width between its first and second ends. The sheet retention device may receive a portion of bedsheet intermediate the retaining member and the first surface of the first flat member. In the invented method, gravity acting on the mattress and the sheet retention device causes the sheet retention device to grip the received portion of the sheet.

In an embodiment, the invention provides a bed sheet retention device configured to at least partially underlie mattress, the device comprising: a first flat member having a first surface; at least one second flat member having a second surface, and wherein the first member communicates with the second flat members in a closed configuration wherein the first and second surfaces oppose each other, in an open configuration wherein the first and second surfaces are perpendicular to each other, and an infinite number of positions in between the open and closed configurations; and at least one sheet retaining member in communication with the first surface. In an embodiment, the device provides that the second flat member is in hinged communication with the first flat member and the retaining member comprises a flat substrate having a first end which communicates with the second surface and a second distal end, wherein the second end is wider than the first end. The device may be adapted to reversibly retain the sheet intermediate the retaining member and the second surface of the second flat member. In an embodiment, the first flat member defines a corner and a terminating edge, and wherein the at least one second flat member comprises a pair of walls extending from the terminating edge of the corner, wherein the walls intersect at the corner of the first flat member, the device further comprising: a keyhole shaped aperture in the center of each the walls wherein each aperture has a circular portion and a substantially rectangular portion wherein the keyhole shaped apertures are disposed such that their circular portions are proximal to the intersection of the walls, and wherein the substantially rectangular portion of the apertures extends away from the intersection of the walls. In an embodiment, the retaining member further comprises: a proximal end and a distal end wherein the proximal end comprises means to reversibly attach the at least one retaining member to a bed sheet and wherein the distal end terminates in a boss such that the cross section of the boss is smaller in diameter than the circular portions of the keyhole shaped apertures but larger in diameter than the substantially rectangular portions of the keyhole shaped apertures. In an embodiment, the proximal end of the at least one retaining member is attached to a bed sheet and the boss is reversibly inserted into the circular portion of a keyhole aperture such that the retaining member pulls the attached portion of bed sheet toward the intersection of the walls. In an embodiment, the retaining member is slidably received by the aperture such that the retaining member is biased toward the substantially rectangular portion of a keyhole aperture when reversibly fixed to a bed sheet. In an embodiment, the invention further comprises comprising a second retaining member. In an embodiment, the retaining member further comprises: an elongated member extending between a first and second end, wherein the first and second ends comprise means to reversibly fix the elongated member to a bed sheet, and wherein the circular portions of the keyhole shaped apertures receive the ends of the elongated member such that a medial portion of the elongated member extends between the keyhole shaped apertures over a laterally facing portion of both walls.

The invention provides a method for preventing slippage of bedsheets comprising: installing at least one sheet retention device such that the sheet retention device reversibly receives a portion of bed sheet, wherein the portion of bed sheet overlays a mattress. In an embodiment, the sheet retention device comprises: a first flat member having a first surface; at least one second flat member having a second surface, and wherein the first member communicates with the second flat members in a closed configuration wherein the first and second surfaces oppose each other, in an open configuration wherein the first and second surfaces are perpendicular to each other, and an infinite number of positions in between the open and closed configurations; and at least one sheet retaining member in communication with the first surface. In an embodiment, the second flat member is in hinged communication with the first flat member and the retaining member comprises a flat substrate having a first end which communicates with the second surface and a second distal end, wherein the second end is wider than the first end. In an embodiment, the device is adapted to reversibly retain the sheet intermediate the retaining member and the second surface of the second flat member. In an embodiment, the method further comprises installing a plurality of sheet retention devices. In an embodiment, the first flat member defines a corner and a terminating edge, and wherein the at least one second flat member comprises a pair of walls extending from the terminating edge of the corner, wherein the walls intersect at the corner of the first flat member, the device further comprising: a keyhole shaped aperture in the center of each the walls wherein each aperture has a circular portion and a substantially rectangular portion wherein the keyhole shaped apertures are disposed such that their circular portions are proximal to the intersection of the walls, and wherein the substantially rectangular portion of the apertures extends away from the intersection of the walls. In an embodiment, the retaining member further comprises: a proximal end and a distal end wherein the proximal end comprises means to reversibly attach the at least one retaining member to a bed sheet and wherein the distal end terminates in a boss such that the cross section of the boss is smaller in diameter than the circular portions of the keyhole shaped apertures but larger in diameter than the substantially rectangular portions of the keyhole shaped apertures. In an embodiment, the proximal end of the at least one retaining member is attached to a bed sheet and the boss is reversibly inserted into the circular portion of a keyhole aperture such that the retaining member pulls the attached portion of bed sheet toward the intersection of the walls. In an embodiment, the sheet retention device further comprises a second retaining member. In an embodiment, the retaining member further comprises: an elongated member extending between a first and second end, wherein the first and second ends comprise means to reversibly fix the elongated member to a bed sheet, and wherein the circular portions of the keyhole shaped apertures receive the ends of the elongated member such that a medial portion of the elongated member extends between the keyhole shaped apertures over a laterally facing portion of both walls.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A bed sheet retention device configured to at least partially underlie a mattress, the device comprising:

a) a first flat member having an exterior surface, a first surface, a proximal end, a distal end, wherein the first flat member has a width that increases between its proximal and distal ends, and wherein the distal end of the first flat member defines a semicircle;

b) a second flat member having an exterior surface a second surface, and wherein the first flat member communicates with the second flat member in a closed configuration wherein the first and second surfaces oppose each other, in an open configuration wherein the first and second surfaces are perpendicular to each other, and an infinite number of positions in between the open and closed configurations, wherein the second flat member has a proximal end and a distal end, wherein the second flat member has a width that increases between its proximal and distal ends, wherein the distal end of the second flat member defines a semicircle, and wherein the first and second flat members are in hinged communication with each other at their proximal ends; and c) a retaining member in communication with the first surface.

2. The device of claim 1 wherein the retaining member comprises a flat substrate having a first end which communicates with the second surface and a second distal end, wherein the second end is wider than the first end, wherein the first end of the retaining member is positioned proximate to the distal ends of the first and second flat members and the distal end of the retaining member is positioned proximate to the proximal ends of the first and second flat members, and wherein the device is configured to receive a portion of a sheet intermediate the retaining member and the second flat member.

3. The device of claim 2 wherein the device is adapted to reversibly retain a sheet intermediate the retaining member and the second surface of the second flat member.

4. The bed sheet retention device of claim 1, wherein the device is configured to retain a bed sheet using only the force of gravity imposed on the exterior surface of the second flat member.

5. The bed sheet retention device of claim 4 wherein hardware such as clamps or other movable parts are not necessary to retain the bed sheet.

6. A method for preventing slippage of bedsheets comprising:

installing at least one sheet retention device such that the at least one sheet retention device reversibly receives a portion of bed sheet, wherein the portion of bed sheet overlays a mattress, and wherein the at least one sheet retention device comprises:

a) a first flat member having an exterior surface, a first surface, a proximal end, a distal end, wherein the first flat member has a width that increases between its proximal and distal ends, and wherein the distal end of the first flat member defines a semicircle;

b) a second flat member having an exterior surface, a second surface, and wherein the first flat member communicates with the second flat member in a closed configuration wherein the first and second surfaces oppose each other, in an open configuration wherein the first and second surfaces are perpendicular to each other, and an infinite number of positions in between the open and closed configurations, wherein the second flat member has a proximal end and a distal end, wherein the second flat member has a width that increases between its proximal and distal ends, wherein the distal end of the second flat member defines a semicircle, and wherein the first and second flat members are in hinged communication with each other at their proximal ends; and c) a sheet retaining member in communication with the first surface.

7. The method of claim 6 wherein in hinged communication with the first flat member and the retaining member comprises a flat substrate having a first end which communicates with the second surface and a second distal end, wherein the second end is wider than the first end, wherein the first end of the retaining member is positioned proximate to the distal ends of the first and second flat members and the distal end of the retaining member is positioned proximate to the proximal ends of the first and second flat members.

8. The method of claim 7 wherein the at least one sheet retention device is adapted to reversibly retain a sheet intermediate the sheet retaining member and the second surface of the second flat member.

9. The method of claim 8 further comprising installing a plurality of sheet retention devices.

10. The method of claim 6 wherein the at least one sheet retention device is configured to retain a bed sheet using only the force of gravity imposed on the exterior surface of the second flat member.

11. The method recited in claim 10 wherein hardware such as clamps or other movable parts are not necessary to retain the bed sheet.

* * * * *